US006173594B1

(12) United States Patent
Majima

(10) Patent No.: US 6,173,594 B1
(45) **Date of Patent: *Jan. 16, 2001**

(54) LOCKING APPARATUS FOR USE IN GAME MACHINE

(75) Inventor: Shiro Majima, Artarmon (AU)

(73) Assignee: Konami Co., Ltd., Hyogo-ken (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/109,358

(22) Filed: Jul. 2, 1998

(30) Foreign Application Priority Data

Aug. 7, 1997 (JP) ..... 9-213442

(51) Int. Cl.[7] ..... E05B 65/52

(52) U.S. Cl. ..... 70/79; 70/467; 70/484; 194/350; 292/117; 292/119; 292/157; 292/254

(58) Field of Search ..... 292/254, DIG. 51, 292/DIG. 55, 117–119, 157, 161; 194/350; 70/78, 79, 467, 484, 485

(56) References Cited

U.S. PATENT DOCUMENTS

| | | | | |
|---|---|---|---|---|
| 489,220 | * | 1/1893 | Currier, Jr. et al. | 292/DIG. 55 X |
| 1,602,762 | * | 10/1926 | Furnas | 292/254 |
| 2,727,800 | * | 12/1955 | Snider | 292/162 X |
| 2,946,640 | * | 7/1960 | Sitler | 292/162 X |
| 3,831,408 | * | 8/1974 | Featherman | 70/278.5 X |
| 3,838,877 | * | 10/1974 | Hanson | 292/254 |
| 4,270,370 | * | 6/1981 | Offelie | 70/282 X |
| 4,341,409 | * | 7/1982 | Sakoda | 292/254 |
| 4,509,779 | * | 4/1985 | Sasaki | 292/254 |
| 4,826,224 | * | 5/1989 | Lee | 292/254 |

FOREIGN PATENT DOCUMENTS

| | | | | |
|---|---|---|---|---|
| 4338611 | | 5/1995 | (DE) . | |
| 19600126 | | 7/1997 | (DE) . | |
| 29708938 U | | 8/1997 | (DE) . | |
| 453485 | * | 6/1913 | (FR) | 292/DIG. 55 |
| 372919 | * | 5/1932 | (GB) | 16/82 |
| 7-39618 | | 2/1995 | (JP) . | |
| 8-131610 | | 5/1996 | (JP) . | |
| 8155118 | | 6/1996 | (JP) . | |

* cited by examiner

*Primary Examiner*—Lloyd A. Gall
(74) *Attorney, Agent, or Firm*—Jordan and Hamburg LLP

(57) ABSTRACT

A locking apparatus of a game machine has the following components: a locking bar provided with a plurality of first engaging portions; engaging members having second engaging portions engageable with the first engaging portions; and a locking bar actuating member for actuating the locking bar from an engaging position where the first engaging portions engage with the second engaging portions to a disengaged position where the first engaging portions are out of engagement with the second engaging portions. A locking device performs, in accordance with operation of a key, a changeover between an unlocked state which permits the actuation of the locking bar into a disengaged position by the locking bar actuating member and a locked state which prohibits the actuation of the locking bar into the disengaged position by the locking bar actuating member. The locking bar is disposed on the main part, while the engaging members, locking bar actuating member and the locking device are disposed on the door hinged to the main part. This arrangement serves to reduce the size of the installation space to be preserved in the main part, while avoiding increase of the weight of the door assembly.

8 Claims, 4 Drawing Sheets

LOCKING APPARATUS FOR USE IN GAME MACHINE

BACKGROUND OF THE INVENTION

1. Field of the Invention

The present invention relates to a locking apparatus which locks a door on a main part of a game machine.

2. Description of the Related Art

In general, a housing constituting a main part of a game machine has a vertically elongated construction and, therefore, a locking apparatus for locking a door on the main part of the game machine is required to lock the door against breaking at a plurality of portions of the door which are spaced in the vertical direction. Hitherto, therefore, a locking apparatus of the kind described has a lock provided on the door at a position near one side edge thereof and a vertically movable locking bar which also is provided on the door. The locking bar is operatively connected to the shaft of the lock such that the locking bar moves up and down in accordance with the rotation of the lock. The locking bar is provided with a plurality of locking pawls which are spaced in the vertical direction, while engaging members engageable with the locking pawls are provided on the main part of the game machine. All the locking pawls are simultaneously brought into or out of engagement with the associated engaging members simply by a vertical stroking of the locking bar. This type of arrangement is disclosed, for example, in Japanese Patent Laid-Open No. 8-155118.

In the known locking apparatus of the type described above, the door carries the vertically elongated locking bar, the lock, and all the members which operatively connect the lock to the locking bar. Consequently, the weight of the door assembly undesirably increases to cause various problems or inconveniences. For instance, the door is required to have a high level of rigidity to carry the heavy weight, and the hinge between the door and the main part of the game machine also has to have a strength high enough to support the heavy weight of the door assembly, resulting in a rise of costs of production of the game machine.

The problems described above would be eliminated if the arrangement is such that only the engaging members are carried by the door, while other components such as the locking bar and the lock are mounted on the main part of the game machine. In such a case, however, the number of parts to be secured to the main part of the game machine increases tremendously, so that a large installation space has to be preserved in the main part of the game machine in order to accommodate these parts.

SUMMARY OF THE INVENTION

Accordingly, it is an object of the present invention to provide a locking apparatus for a game machine, which is improved to reduce the weight to be borne by the door, without requiring an increase in the installation space to be preserved in the main part of the game machine.

To this end, according to the present invention, there is provided a locking apparatus of a game machine, having a locking bar provided with a plurality of first engaging portions, engaging members having second engaging portions engageable with the first engaging portions, a locking bar actuating member for actuating the locking bar from an engaging position where the first engaging portions engage with the second engaging portions to a disengage position where the first engaging portions are out of engagement with the second engaging portions, and locking means which performs, in accordance with operation of a key, a change-over between an unlocking state which permits the actuation of the locking bar into the disengage position by the locking bar actuating member and a locking state which prohibits the actuation of the locking bar into the disengage position by the locking bar actuating member, wherein the locking bar is disposed on one of a game machine main part and a door which is secured to the main part, while the engaging members, locking bar actuating member and the locking means are disposed on the other of the main part and the door.

The locking bar is an elongated member and, hence, has to have a high level of rigidity in order to offer high strength and tightness of the locking apparatus. The locking bar, therefore, is the heaviest component among the components of the locking apparatus. In accordance with the present invention, the heaviest locking bar is borne by one of the door and the main part of the game machine, while other components such as the engaging members, locking rod actuating member and the locking means are carried by the other of the door and the main part. Consequently, the door is required to bear less weight than in the conventional arrangements in which the door carries the heavy components such as the locking bar, locking bar actuating member and the locking means. In addition, the installation space to be preserved inside the main part of the game machine is not increased significantly, as compared with the case where the major components including the locking bar, locking bar actuating member and the locking means are mounted inside the main part of the game machine.

According to the invention, the arrangement may be such that the engaging members, locking bar actuating member and the locking means are disposed on the door, while the locking bar is disposed on the main part of the game machine.

According to this arrangement, two different operations: namely, an unlocking operation for unlocking the locking means by using a key, and a disengaging operation for bringing the locking bar from an engaging state into a disengaged state through the action of the locking bar actuating member, can be easily and consecutively performed from the outside of the door.

Preferably, the locking bar actuating member has an operation knob operable externally of the door, the locking means has a locking member movable, in accordance with the operation of the key, between a locking position where the locking member prohibits operation of the locking bar actuating member and an unlocking position where the locking member permits operation of the locking bar actuating member, and wherein the locking bar is held in the engaging position when the locking bar actuating member is constrained by the locking member against operation.

According to this arrangement, the change-over between the locking and unlocking states is performed by the action of the locking member through the locking means. The door can be opened by operating the operation knob so as to bring the locking bar from the engaging position to the disengaging position, after the locking member has been moved to the unlocking position by the operation of the locking means. With this arrangement, therefore, all the operations necessary for opening the door, such as unlocking of the locking means, operation of the operation knob and the swinging of the door can be done without requiring any action to be done on the main part, so that the door can be opened easily. The operation knob can be used as a knob on which the manual force is exerted for swinging the door into open position.

Preferably, the arrangement is such that the operation knob of the locking bar actuating member is operable in the same direction as the movement of the locking bar. Therefore, there is no need for provision of a device which would otherwise be necessary for the purpose of transforming the direction of movement of the locking bar actuating member into the direction of movement of the locking bar. Consequently, the number of parts is reduced to prevent any increase in the size of the installation space to be preserved in the game machine.

The locking bar actuating member and the locking means are separate members or may be integrated with each other.

Preferably, the arrangement is such that the first and second engaging portions engage with each other when the locking bar is at the lower end of its stroke, and urging means are provided for urging the locking bar towards the lower end of the stroke.

According to this arrangement, the locking bar is urged into the engaging position by the combined effect of its weight and the urging force exerted by the urging means, so that the locking bar can move to the engaging position without fail, even when its weight is comparatively small.

It is also preferred that the locking apparatus further comprises a roller provided on one of the door and the main part of the game machine; and a guide member provided on the other of the door and the main part and having a tapered surface, the roller and the tapered surface being engageable with each other when the door is closed, so as to produce upward force acting on the door.

With this arrangement, the tendency for the door to incline due to its weight is prevented by virtue of the engagement between the roller and the guide member, when the door is being moved to the closing position.

Preferably, at least one of the first engaging portions and the second engaging portions have tapered surfaces for engagement with the other.

In accordance with this arrangement, the first and second engaging portions, when brought into contact with each other, produces an upward force which acts to lift the locking bar against the combined force of the urging means and the weight of the locking bar. The locking bar then moves downward the combined force, so that a first engagement is achieved between the first and second engaging portions.

The above and other objects, features and advantages of the present invention will become clear from the following description when the same is read in conjunction with the accompanying drawings.

DESCRIPTION OF THE PREFERRED EMBODIMENT

Figure 4B:
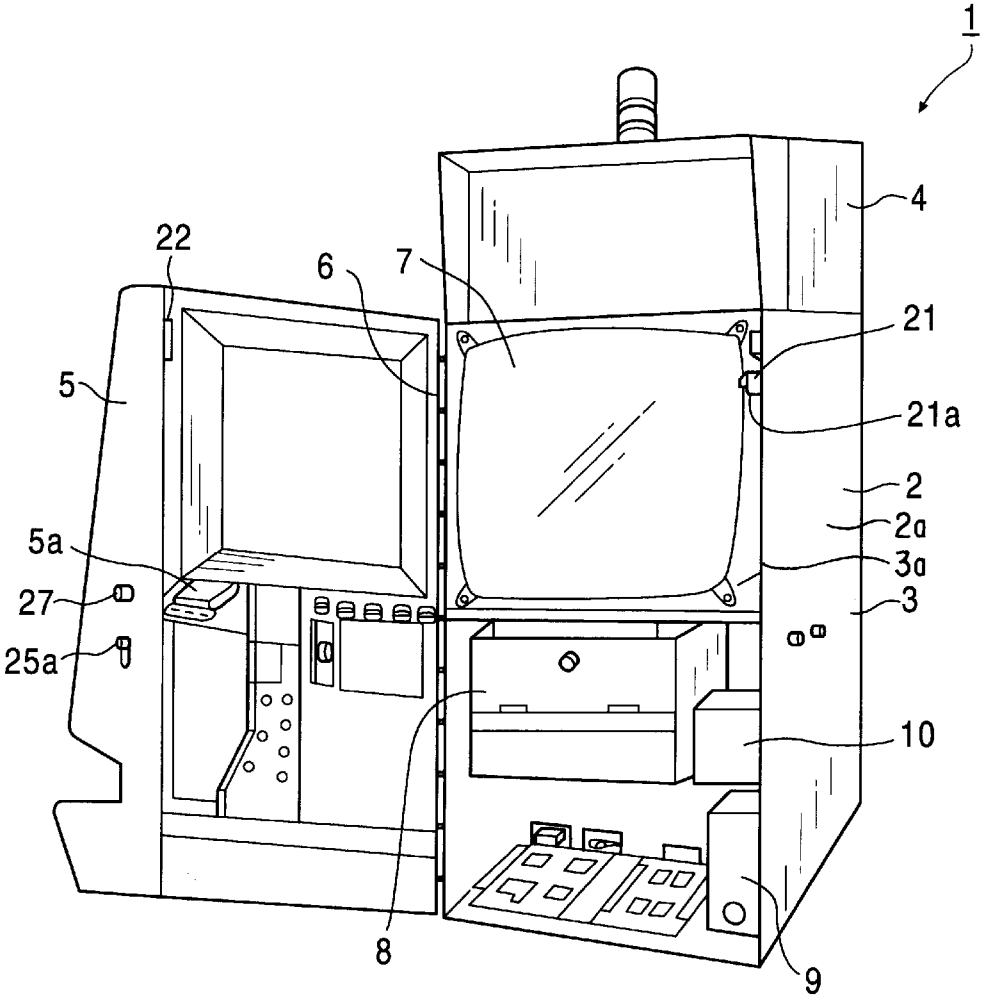
FIGS. 4A and 4B are illustrations of the slot machine incorporating the locking apparatus embodying the present invention, in a state in which the door has been closed and in a state in which the door has been opened to show the internal equipment.
Figure 4A:
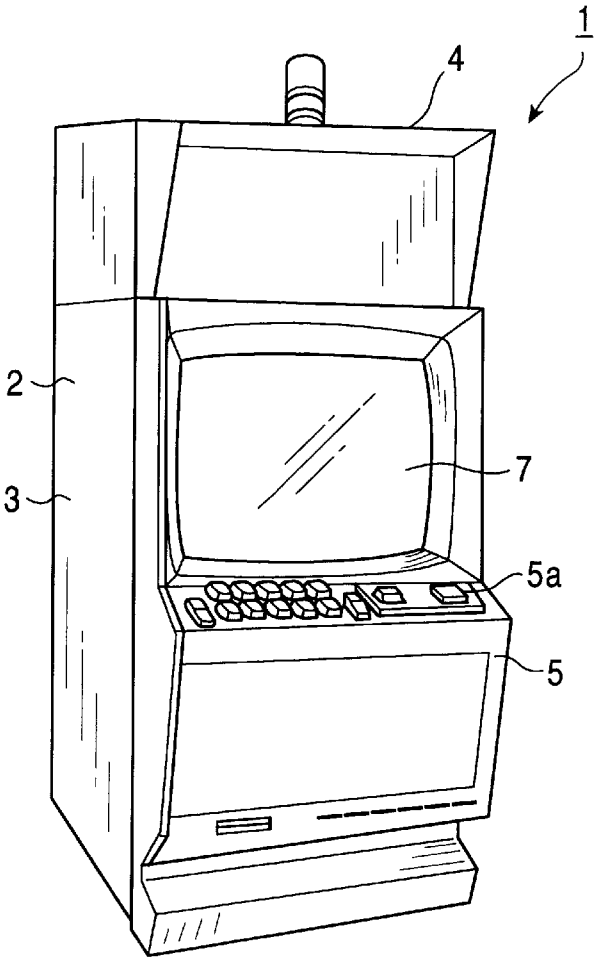

Referring to FIGS. 4A and 4B, a slot machine is a typical game machine incorporating a locking apparatus of the present invention and has a vertically elongated housing 2 and various components and parts mounted in and on the housing 2. The housing 2 includes a main part 3 and a top box 4 provided on the main part 3. A door 5 is swingably connected to the front side of the main part 3 by means of a hinge 6 provided on the left side edge thereof, so as to be swingable between an open position and a close position. The main part 3 accommodates a monitor 7. Disposed under the monitor 7 are an electric console 8, an A.C. power supply unit 9 and a mounting base 10 for mounting a slip verification unit (not shown) which verifies a slip inserted through a slit 5*a* formed in the door 5.

Figure 1:
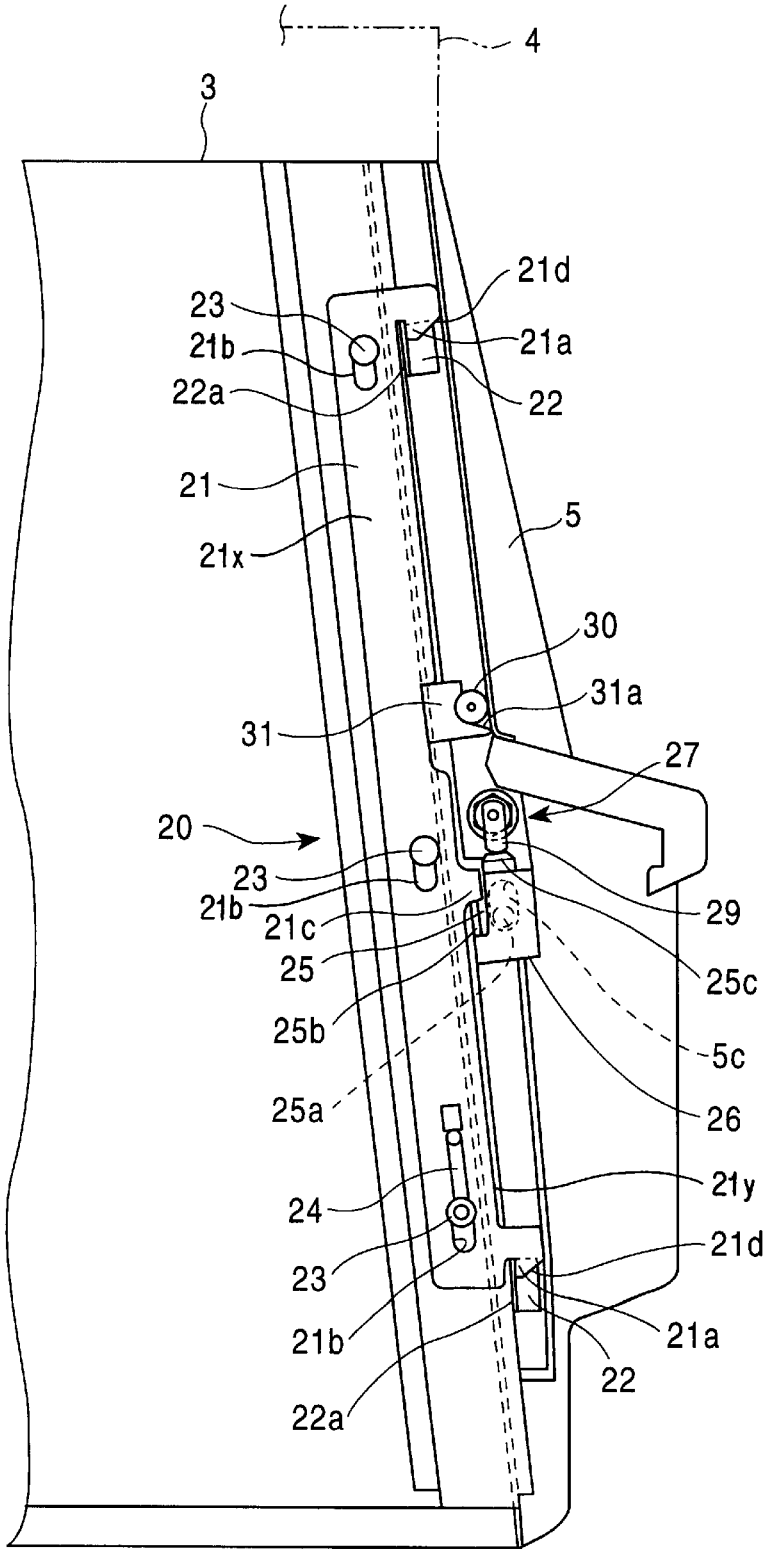
FIG. 1 is an illustration of a portion of a main part and a door of a slot machine incorporating an embodiment of the locking apparatus of the present invention, as viewed from the interior of a housing constituting the main part.
Figure 2:
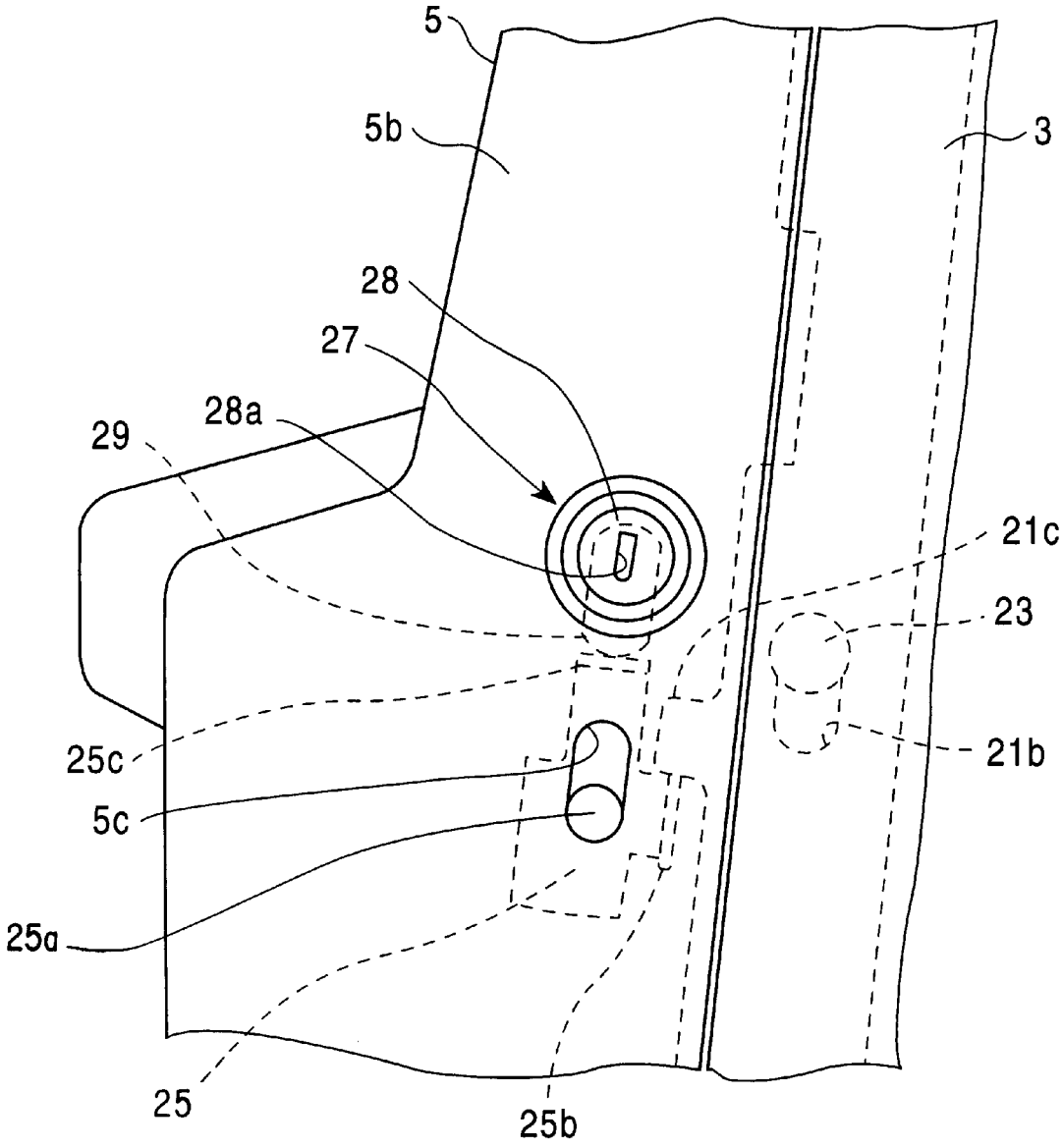
FIG. 2 is a plan view of a critical portion of the structure shown in FIG. 1, as viewed from the exterior of the housing.

As will be seen from FIGS. 1 and 2, a locking apparatus 20 is provided for locking the free side, i.e., the right side remote from the hinge 6, of the door 5 onto the associated side surface 2*a* of the main part 3 of the housing 2. The locking apparatus 20 has a locking bar 21 disposed on the main part 3, adjacent a front surface 3*a* and a pair of engaging members 22, 22 provided on the door 5 and vertically spaced from each other. The locking bar 21 is an elongated sheet member with opposed flat planar side surfaces 2*x* extending substantially upright, and is provided at its upper and lower end portions along its edges 21*y* with pawls 21*a*, 21*a* serving as the first engaging portions.

The locking bar 21 is also provided with three elongated holes 21*b* having axes extending in the longitudinal direction of the locking bar 21. These three elongated holes 21*b* slidably receive respective guide pins 23 fixed to the main part 3, so that the locking rod 21 is carried on the main part 3 for vertical movement. The abovementioned engaging members 22 are fixed to the inner surface of the door 5 by suitable fixing means such as bolts (not shown). Engaging projections 22*a*, 22*a* engageable with the pawls 21*a*, 21*a* are provided on the ends of the engaging members 22, 22 adjacent to the main part 3.

A tensile coiled spring 24 is stretched between the locking bar 21 and the lowermost guide pin 23. The locking bar 21 is held at the lower end of its stroke, i.e., the position shown in FIG. 1, by the combined effect produced by the downward pulling force exerted by the tensile coiled spring 24 and the weight of the locking bar 21 itself. The engagement between the pawls 21*a* and the engaging projections 22*a* is achieved to lock the door 5 in the closed position when the locking bar 21 is held at this position. This position, therefore, is referred to also as an "engaging position". The door 5 can be opened when the locking bar 21 is moved upward to disengage the pawls 21*a* from the associated engaging projections 22*a*.

Figure 3B:
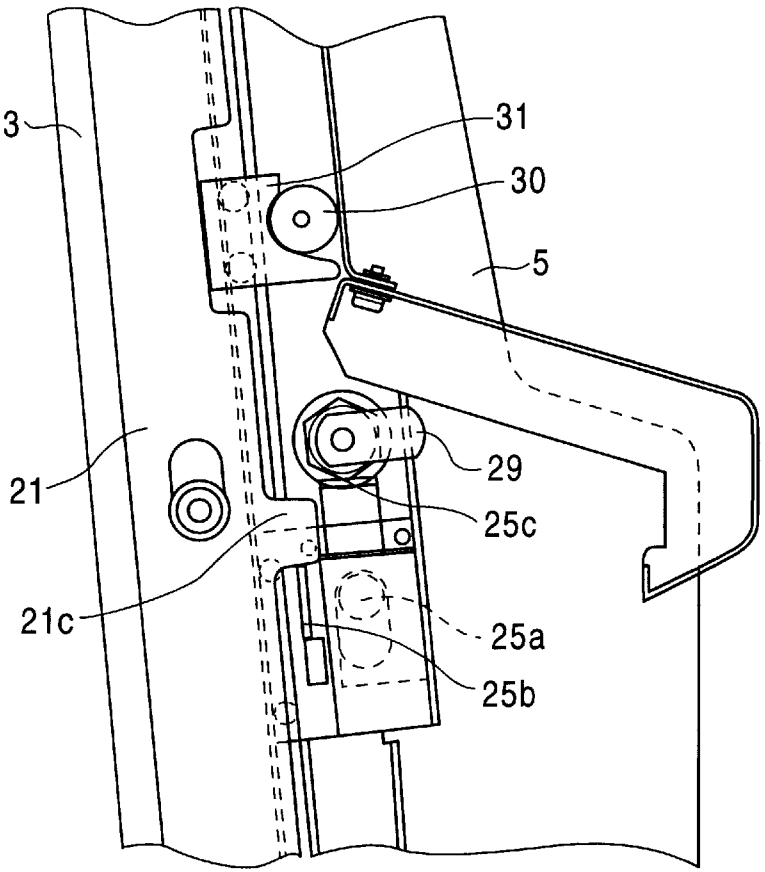
FIGS. 3A and 3B are illustrations of the locking apparatus in locked and unlocked states, respectively.
Figure 3A:
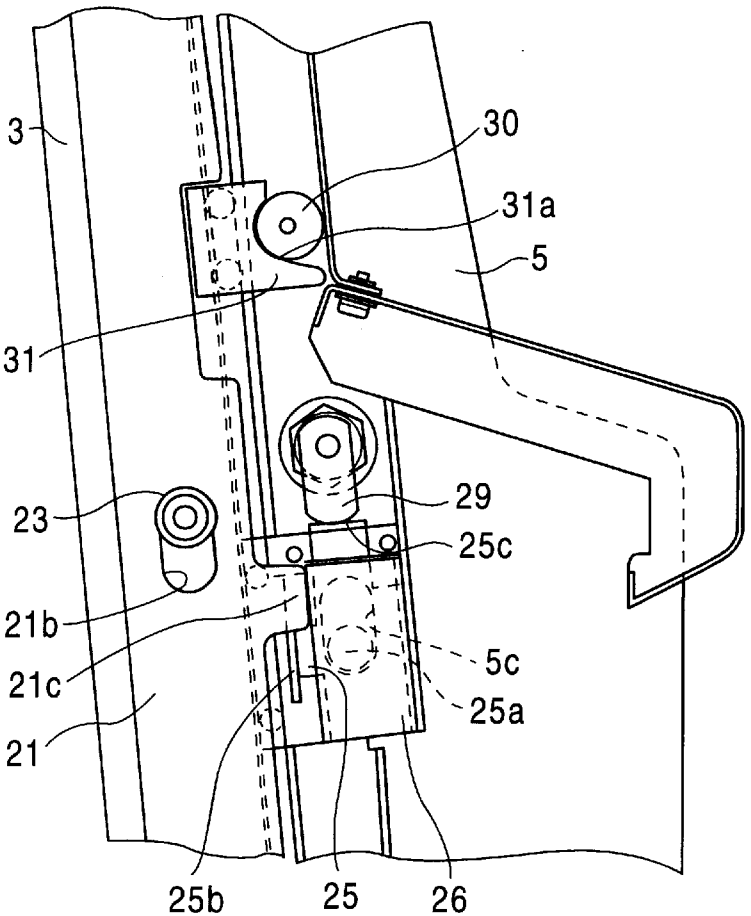

Referring to FIGS. 2, 3A and 3B, the upward movement of the locking bar 21 is effected by a locking bar actuating member 25 provided on the inner surface of the door 5. More specifically, the locking bar actuating member 25 is supported by a bracket 26 fixed to the inner surface of the door 5, so as to be movable in the same direction as the direction of movement of the locking bar 21. The locking bar actuating member 25 is provided with a cylindrical operation knob 25*a* (see FIG. 1) which projects outward through an elongated hole 5*c* formed in the door 5. The locking bar actuating member 25 is also provided with a tabular actuating projection 25*b* which projects beyond the bracket 26 towards the locking bar 21. When the door 5 is in the closed position, the actuating projection 25*b* engages with the lower end of a projection 21*c* of the locking bar 21.

A lock 27 is provided on the door 5 at a position above the operation knob 25*a*. The lock 27 has a rotary shaft 28 which is normally prohibited to rotate but becomes rotatable when a predetermined key (not shown) is inserted into a key hole

28*a* formed in the outer surface of the door 5. The lock 27 further has a tabular locking member 29 which is connected to the rotary shaft 28 at a position inside the door 5. As will be seen also from FIGS. 3A and 3B, a tabular restraining portion 25*c* for cooperation with the locking member 29 is provided on the locking bar actuating member 25.

In operation of the locking apparatus 20 having the described construction, when the rotary shaft 28 of the lock 27 is rotated to bring the locking member 29 to the position shown in FIG. 3A, the locking member 29 engages with the restraining portion 25*c* of the locking bar actuating member 25, so that the locking bar actuating member 25 is prevented from moving upward. In this state, it is impossible to upwardly move the operation knob 25*a* externally of the door 5 and, hence, the locking bar 21 cannot be lifted from the engaging position. In this state, therefore, the locking bar 21 is fixed at the engaging position shown in FIG. 3A by the combined effect of the tensile coiled spring 24 and the weight of the locking bar 21 itself, as explained before, so that the engaging pawls 21*a* are held in engagement with the associated engaging projections 22*a* of the engaging members 22, whereby the door 5 remains locked against opening action.

However, when the locking member 29 is moved to the position shown in FIG. 3B, the locking member 29 leaves the restraining portion 25*c* so as to allow the locking bar actuating member 25 to move upward. Thus, the lock 27 is unlocked, so that the locking bar 21 can be moved upward to an upper disengagement position as the locking bar actuating member 25 is moved upward by upward force exerted on the operation knob 25*a* externally of the housing 2. As a result, the engaging pawls 21*a* of the locking bar 21 are disengaged from the engaging projections 22*a* of the engaging members, so as to allow the door 5 to open. The described operation for opening the door 5 can be done in an efficient manner because the two types of actions: namely, unlocking of the lock 27 and the upward lifting of the operation knob 25*a,* can be performed consecutively at positions which are vertically adjacent to each other.

When the door 5 is swung to the closed position, a roller 30 rotatably carried by the door 5 rolls onto a tapered surface 31*a* of a guide member 31 provided on the main part 3, whereby the door 5 is prevented from inclining due to the weight thereof. At the same time, tapered surfaces 21*d* formed on the engaging pawls 21*a* of the locking bar 21 are brought into mating surfaces of the engaging projections 22*a* of the engaging members 22, so that a force is generated to lift the locking bar 21 against the force of the coiled spring 24. A further movement of the door 5 to the closing position causes the engaging projections 22*a* to pass the tapered surfaces of the engaging pawls 21*a,* so that the locking bar 21 is caused to move downward by the combined effect of the force of the spring 24 and the weight thereof, whereby the engaging pawls 21*a* are brought into engagement with the associated engaging projections 22*a*.

Although the invention has been described through its specific forms, it is to be understood that the described embodiments are only illustrative and various changes and modifications may be imparted thereto. For instance, the arrangement may be such that the locking bar 21 is disposed on the door 5, while other components such as the engaging members 22, locking bar actuating member 25 and the lock 27 are carried by the main part 3 of the game machine. The arrangement also may be such that a lever-type locking bar actuating member is directly provided on the rotary shaft 28 integrally therewith, so as to substitute for the separate locking bar actuating member 25 employed in the described embodiment, so that the change-over between locked and unlocked state and the actuation of the locking bar into and out of the engaging position are simultaneously performed at the same portion of the locking apparatus.

It will be clear that the invention can be applied to a variety of game machines, although a slot game has been specifically mentioned in the foregoing description.

As will be fully understood from the foregoing description, according to the present invention, the total weight of the whole locking apparatus is suitably shared both by the door and the main part of the game machine, such that, while the locking bar which is the heaviest component is carried by the main part, other components including the engaging members, locking bar actuating member and the lock are carried by the door, or vice versa. It is thus possible to reduce the size of the installation space to be preserved in the main part of the game machine, while avoiding increment of the weight of the door assembly. When the locking bar is provided on the main part, two types of operations: namely, change-over between locked and unlocked state of the lock and actuation of the locking bar by the locking bar actuating member, can be done efficiently at two adjacent positions on the door. When the locking apparatus is designed such that the direction of operation of the locking bar actuating member and the direction of movement of the locking bar are the same, the number of parts of the locking apparatus is reduced by virtue of elimination of a mechanism for converting the direction of action, so that the required size of the installation space is further reduced, as well as production costs and burden of protective maintenance of the locking apparatus.

What is claimed is:

1. A game machine, comprising:

a main chassis part having a front surface extending in a width direction of said main chassis part and a side surface extending in a depth direction of said main chassis part;

said front surface including a door hingeably connected to said main chassis part;

a locking bar slidably disposed on said main chassis part and formed as an elongated planar sheet member extending in an elongated direction substantially upright and having opposing flat planar side surfaces having elongated edges with a plurality of first engaging portions extending from said elongated edges in a planar direction of said elongated planar sheet member, said flat planar side surfaces being oriented substantially parallel to said side surface of said main chassis part;

engaging members disposed on said door and having second engaging portions engageable with said first engaging portions;

a locking bar actuating member, disposed on said door, for actuating said locking bar from an engaged position where said first engaging portions engage said second engaging portions to a disengaged position where said first engaging portions are out of engagement with said second engaging portions; and locking means, disposed on said door, for prohibiting movement of said locking bar from said engaged position and for permitting movement of said locking bar from said engaged position in response to operation of a key.

2. The game machine according to claim 1, wherein:

said locking bar actuating member has an operation knob operable externally of the door;

said locking means has a locking member movable, in response to the operation of the key, between a locking position where movement of said locking bar actuating member from a position whereat said locking bar is in said engaged position is prohibited and an unlocking position where movement of said locking bar from said engaged position by said locking bar actuating member is permitted; and wherein said locking bar is held in said engaged position when said locking bar actuating member is constrained against operation by said locking member.

3. The game machine according to claim 2, wherein said operation knob of said locking bar actuating member is operable in the same direction as the movement of said locking bar.

4. The game machine according to one of claims 1, 2 or 3, wherein said locking bar actuating member and said locking means are separate members.

5. The game machine according to one of claims 1, 2 or 3, further comprising urging means for urging said locking bar towards a lower end of a movement range of said locking bar where said first and second engaging portions engage with each other.

6. The game machine according to one of claims 1, 2 or 3, further comprising:

a roller provided on one of said door and said main chassis part; and a guide member provided on another one of said door and said main chassis part and having a tapered surface disposed such that said roller and said tapered surface are engageable with each other when said door is closed so as to produce upward force acting on said door.

7. The game machine according to one of claims 1, 2 or 3, wherein at least one of said first engaging portions and said second engaging portions have tapered surfaces for slidable engagement with the other.

8. The game machine according to claim 3, wherein said locking means and said operation knob are aligned adjacent to each other along a sliding direction of said locking bar.

* * * * *